US008631539B2

(12) United States Patent
Williams et al.

(10) Patent No.: US 8,631,539 B2
(45) Date of Patent: Jan. 21, 2014

(54) ACCESSORY WAND STORAGE ASSEMBLY FOR USE WITH VACUUM APPLIANCES, AND VACUUMS USING THE SAME

(75) Inventors: Matthew A. Williams, Bridgeton, MO (US); Douglas K. Ritterling, Chesterfield, MO (US); Shane Glasgow, Saint Ann, MO (US)

(73) Assignee: Emerson Electric Co., St. Louis, MO (US)

( * ) Notice: Subject to any disclaimer, the term of this patent is extended or adjusted under 35 U.S.C. 154(b) by 365 days.

(21) Appl. No.: 13/172,805

(22) Filed: Jun. 29, 2011

(65) Prior Publication Data

US 2011/0314628 A1 Dec. 29, 2011

Related U.S. Application Data

(60) Provisional application No. 61/359,820, filed on Jun. 29, 2010.

(51) Int. Cl.
*A47L 5/00* (2006.01)

(52) U.S. Cl.
USPC ..... 15/323; 15/327.2

(58) Field of Classification Search
USPC ..... 15/323, 327.2
IPC ..... A47L 5/00
See application file for complete search history.

(56) References Cited

U.S. PATENT DOCUMENTS

| | | | | |
|---|---|---|---|---|
| D318,544 | S | 7/1991 | Schoettler | |
| D325,453 | S | 4/1992 | Tsuge | |
| 5,125,127 | A * | 6/1992 | Bach et al. | 15/323 |
| 5,313,686 | A | 5/1994 | Berfield | |
| D355,283 | S | 2/1995 | Thomas et al. | |
| 5,528,794 | A | 6/1996 | Tomasiak | |
| D381,481 | S | 7/1997 | Medema et al. | |
| D386,842 | S | 11/1997 | Hoshino et al. | |
| D399,616 | S | 10/1998 | Bobrosky et al. | |
| D418,643 | S | 1/2000 | Hoshino | |
| D422,763 | S | 4/2000 | Tsuda | |
| D423,154 | S | 4/2000 | Rohn et al. | |
| 6,098,241 | A | 8/2000 | Wood | |
| 6,101,669 | A | 8/2000 | Martin et al. | |
| D432,746 | S | 10/2000 | Frey | |
| D435,322 | S | 12/2000 | DeBlasis et al. | |
| D443,119 | S | 5/2001 | Sung | |
| 6,237,187 | B1 * | 5/2001 | Hult et al. | 15/323 |
| D467,693 | S | 12/2002 | Kitts | |
| D467,694 | S | 12/2002 | Kitts | |
| 6,510,582 | B1 * | 1/2003 | Yoo | 15/323 |
| D477,443 | S | 7/2003 | Kondo et al. | |
| D481,839 | S | 11/2003 | Almqvist et al. | |
| D496,764 | S | 9/2004 | Lopano | |
| D506,042 | S | 6/2005 | Griffin et al. | |
| D528,256 | S | 9/2006 | Beth et al. | |

(Continued)

*Primary Examiner* — David Redding
(74) *Attorney, Agent, or Firm* — Sutton McAughan Deaver PLLC

(57) ABSTRACT

A vacuum extension wand accessory storage assembly for use with a wet/dry vacuum that improves user access to the wands while simultaneously preventing accidental loss or dislodgement of the wands when the vacuum is not in use. The wand storage design includes the combination of a channeled, shaped surface formed in the bottom of the vacuum collection drum and an accessory attachment system on the bottom of the vacuum appliance having both front and rear securement assemblies which in combination secure the extension wands in place below the collection drum of the vacuum appliance in the event of vacuum transportation, lifting, or storage.

6 Claims, 8 Drawing Sheets

(56) References Cited

U.S. PATENT DOCUMENTS

| | | | |
|---|---|---|---|
| D537,579 | S | 2/2007 | Zimmerle et al. |
| D537,581 | S | 2/2007 | Zimmerle et al. |
| D537,992 | S | 3/2007 | Hoshino |
| D549,903 | S | 8/2007 | Eccardt et al. |
| D549,904 | S | 8/2007 | Eccardt et al. |
| 7,284,297 | B2 | 10/2007 | Shanor et al. |
| D558,410 | S | 12/2007 | Hill et al. |
| D564,154 | S | 3/2008 | Hollis et al. |
| D568,009 | S | 4/2008 | Lam |
| D568,562 | S | 5/2008 | Griffin et al. |
| D568,564 | S | 5/2008 | Griffin et al. |
| D568,565 | S | 5/2008 | Griffin et al. |
| D571,513 | S | 6/2008 | Griffin et al. |
| D577,164 | S | 9/2008 | Williams et al. |
| D581,114 | S | 11/2008 | Crevling, Jr. et al. |
| D581,608 | S | 11/2008 | Dammkoehler et al. |
| D581,609 | S | 11/2008 | Conrad et al. |
| D584,016 | S | 12/2008 | Hosoda et al. |
| D584,462 | S | 1/2009 | Umeda et al. |
| D584,463 | S | 1/2009 | Jansson et al. |
| D596,359 | S | 7/2009 | Hollis et al. |
| D618,870 | S | 6/2010 | Williams et al. |

* cited by examiner

ACCESSORY WAND STORAGE ASSEMBLY FOR USE WITH VACUUM APPLIANCES, AND VACUUMS USING THE SAME

CROSS REFERENCE TO RELATED APPLICATIONS

The present application claims priority to U.S. Provisional Patent Application Ser. No. 61/359,820, filed Jun. 29, 2010, the contents of which are incorporated herein by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to vacuum wand and wand extension storage assemblies on a vacuum appliance, and more specifically are related to vacuum extension wand storage assemblies for use with a vacuum appliance so as to allow for storage of one or more vacuum wands or similar vacuum accessories under a vacuum's debris collection drum in a securable and readily detachable manner.

2. Description of the Related Art

Vacuum appliances capable of picking up both wet and dry material, commonly referred to as wet/dry vacuums or wet/dry vacs, are often used in workshops and other environments where both wet and dry debris can accumulate. Wet/dry vacuum appliances conventionally consist of a collection canister or drum, and a power head fitted to the top of the drum, and within which a motor and impeller assembly is mounted. The motor and impeller assembly creates a suction within the drum, such that solid and/or liquid debris is drawn in to the drum through an air inlet to which a flexible hose can be attached. A filter within the drum prevents incoming debris from escaping from the drum while allowing filtered air to escape. Any liquid drawn into the drum is diffused and accumulates on the bottom of the drum. The drum typically includes a drain opening that is stopped by a plug or threaded cap, so that a user can remove the cap to drain accumulated liquid from the drum. Vacuums may include holders for storing accessories, such as brushes, crevice tools, extension wands, end fitting, etc. In some examples, the holders are permanently secured to the vacuum and cannot be readily removed. In other examples, the holders are portable and detachable members that are independent of the vacuum. Detachable holders are especially desirable, for example, when an operator empties debris from a drum of a wet/dry vacuum.

One of the foremost attributes of vacuum cleaners, particularly wet/dry vacuum cleaners, is the fact that they are both user friendly and versatile. They provide thorough and efficient cleaning of both dry and wet debris, and generally may be easily directed and controlled to clean the work area. In order to add to the versatility of vacuum appliances, such as wet/dry vacuum cleaners, many vacuum appliances are now equipped with various tools and cleaning accessories such as extension hoses, wands, upholstery brushes, squeegee tools, and crevice cleaning tools. These tools and accessories allow the vacuum appliance to be used to complete a variety of special cleaning applications such as the cleaning of furniture and draperies and hard-to-reach areas where the size of the vacuum cleaner would otherwise prevent cleaning due to size and weight concerns.

As indicated above, user convenience considerations require that the tools and accessories, such as the vacuum hose extension wands, be quickly and conveniently available to the vacuum cleaner operator. Accordingly, many vacuum appliances are provided with tool storage compartments that are generally built in to the power head assembly, or in to the caster housings for the wheels of the vacuum. Still others are provided with removable caddies that hold the various tools and cleaning accessories, but with no particular securement means. Such caddies may be mounted and carried on the housing of the upright vacuum cleaner or removed and stored at a remote location as desired by the operator. Many recent versions of such vacuum cleaners have included tool holder accessories mounted to the outer wall of the drum itself. Such tool holders can be provided in a number of forms to enable hoses, nozzles, brushes, and other vacuum cleaner accessories to be stored or mounted thereto when not in use. For example, such tool holders can extend outwardly from the side wall of the collection drum and include a number of outwardly or upwardly extending appendages which are sized to receive each of the tools in a frictional arrangement.

Unfortunately, existing detachable holders for accessories on wet/dry vacuums have some disadvantages. Some existing detachable holders slip fit onto the vacuum and do not positively latch or attach to a feature on the vacuum. With such a slip fit, the detachable holder can work loose and possibly fall off during use or movement of the vacuum. In addition, some existing detachable holders hang on posts or tabs attached to the vacuum. These detachable holders are not fully supported by the posts or tabs and may spill the accessories or catch on stairs when the vacuum is hauled, moved or lifted.

An example of such an accessory tool holder, or caddy as it is sometimes termed, is described in U.S. Pat. No. 5,528,794, which describes a utility vacuum cleaner tool caddy for utility vacuum cleaner drums as well as an axle-less wheel mount. The tool caddy has rear and front wheels with integral rear and front bumpers at least partially overlying the rear and front wheels. This provides a wider/larger wheel base/caddy which increases the stability of the utility vacuum cleaner during movement. The rear bumper is also provided with a plurality of spaced openings for receiving a corresponding number of vacuum tools which are stored in an out-of-the-way location when moving or storing the utility vacuum cleaner. Additionally, the wheel support increases the load capacity while improving the overall look and appearance of the base unit or tool caddy.

U.S. Pat. No. 5,943,731 describes an accessory holder for a vacuum cleaner having a base member for supporting a plurality of vacuum accessories. The base member has a pair of arms for attaching the holder to a support structure on the vacuum cleaner. The arms include a tapered wedge projecting from the base member for intermeshing with a tapered channel in the support structure to provide a frictional retaining attachment of the base member to the support structure. The holder further includes a cradle portion extending from the base member for selectively engaging a portion of the vacuum cleaner wand to detachably secure the holder to the wand.

U.S. Pat. No. 7,159,272 provides a holder for storing accessories on a wet/dry vacuum. The holder securely attaches to the vacuum and readily detaches therefrom. The detachable holder may be detached with the accessories. While an operator dumps debris out of the drum of the vacuum, detaching the holder prevents the accessories from being inadvertently spilled out of or discarded from the holder. The detachable accessory holder fully secures to a bracket attached to the vacuum. The secure attachment prevents the holder from falling off or tipping on the vacuum. To attach the holder to the bracket and vacuum, grooves on the holder are set on to an axle of the vacuum. As the holder is pivoted about the axle, tabs and a latch on the holder engage slots and a step on the bracket. To remove the holder, the operator presses on the latch and lifts the holder from the bracket and the appliance.

Other vacuum tool accessory holders use the wheel casters of the vacuum cleaner as the means by which the vacuum tools and accessories are stored when not in use. Examples of this approach include those disclosed in U.S. Pat. No. 4,827,564 and U.S. Pat. No. 5,924,165, which describe caster foot assemblies for use with an appliance such as a wet/dry vacuum. The caster foot assembly include a body, at least one vacuum accessory securing post in the body, and a caster receptacle in the body, wherein the securing post and the caster receptacle vertically overlap within the body to lower the center of gravity of the appliance.

All of these approaches to tool accessory storage, however, can have issues with the storage of the vacuum hose extension wands, which due to their length and rigidity can be cumbersome to secure in an upright manner in a caddy or on a caster, particularly when the user wishes to transport, lift or store the vacuum in a confined space.

The inventions disclosed and taught herein are directed to improved storage assemblies for use with wet/dry vacuum appliances so as to more efficiently store and secure vacuum wand extensions under the vacuum debris collection drum, thereby providing unwanted dislodgment of the wands when they are stored but not in use, and/or to prevent accidental loss of the wands when they are not in use.

BRIEF SUMMARY OF THE INVENTION

Described herein is a bottom-mount vacuum hose wand storage assembly, and vacuum appliances including such an assembly, as well as methods for the use of such assemblies to securably store vacuum hose wands when not in use, and during vacuum movement and storage.

In accordance with one aspect of the present disclosure, a vacuum appliance is described, such as a wet/dry vacuum appliance, wherein the vacuum comprises a collection drum having a bottom and an outside wall, the bottom of the drum having at least one channel with an arched surface being formed into the bottom face thereof; a lid mounted to the collection drum; a motor impeller unit mounted in the lid; and, a vacuum extension wand storage assembly attached to the bottom face of the collection drum, the wand storage assembly comprising a front vacuum extension wand securement assembly and a rear vacuum extension wand securement assembly spaced longitudinally apart from the front securement assembly.

In accordance with a further aspect of the present disclosure, a vacuum extension wand storage assembly for use with a vacuum appliance having a collection drum with a bottom and upwardly extending sides is described, wherein the assembly comprises a front vacuum extension wand securement assembly attached to the bottom of the collection drum; a rear vacuum extension wand securement assembly attached to the bottom of the collection drum, and spaced longitudinally apart from the front securement assembly; and a tool caddy receptacle formed with the rear wand securement assembly and which aligns with an outward wall of the collection drum, wherein the caddy further includes a bottom wall from which a continuous side wall upwardly extends. In further aspects of this embodiment, the vacuum wand extension assembly is located integral with at least one, preferably two channeled, arched surfaces formed in the bottom face of the collection drum and sized to receive a vacuum extension wand. In yet another aspect of this embodiment, the front wand securement assembly includes a wand positioning and retaining stop. In still further aspects of the disclosure, the rear wand securement assembly includes wand centering ribs formed in a retaining ring, one or more springing means to elevate the extension wands into the arched channel formed in the bottom face of the vacuum drum and guide them towards the front securement assembly, or both.

In yet another aspect of the present disclosure, methods of attaching vacuum extension wands into a vacuum wand securement assembly attached to a wet-dry vacuum cleaner are described, the methods comprising mounting a vacuum wand securement assembly onto the bottom face of a collection drum of a wet-dry vacuum cleaner, wherein the bottom face of the collection drum includes arched channels formed in the bottom face of the drum, and wherein the wand securement assembly includes a front wand securement assembly region having at least one wand-positioning and retaining tabbed stop means, and, a longitudinally spaced apart rear wand securement assembly having at least one substantially circular aperture formed therein, the aperture including plurality of wand-centering ribs circumscribing the inner face, such that the front retaining means, arched channels, and circular apertures are substantially in a planar alignment; inserting a vacuum extension wand into the securement assembly by inserting the front of the extension wand through the circular aperture in the rear assembly, along an arched channel, and towards the front securement assembly; and positively connecting the front of the extension wand with the front securement assembly by engaging the wand with the tabbed stop means.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1:
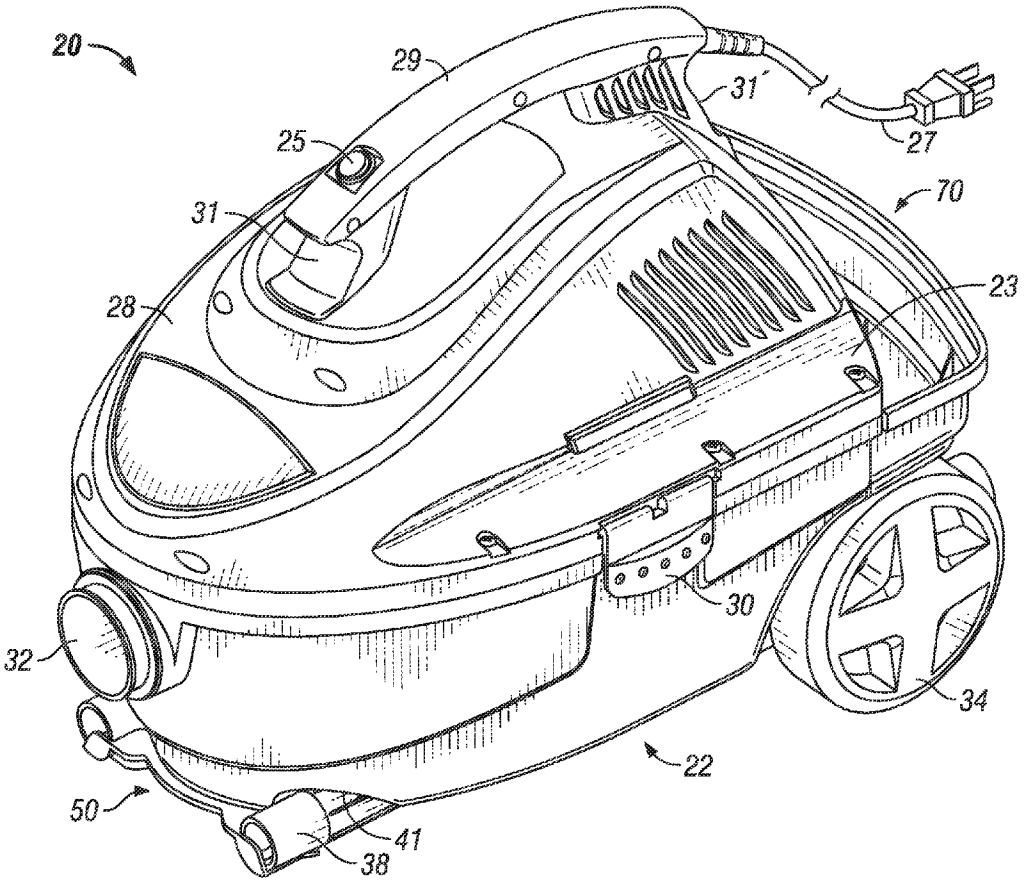
FIG. 1 illustrates a front perspective view of an exemplary vacuum appliance in accordance with aspects of the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created improved storage assemblies for use with wet/dry vacuum appliances so as to more efficiently store and secure vacuum wand extensions under the vacuum debris collection drum, thereby providing unwanted dislodgment of the wands when they are stored but not in use, and/or to prevent accidental loss of the wands when they are not in use. In particular, the described wand storage assembly combines a channeled, shaped surface in the bottom face of the vacuum debris collection drum and a pass-through opening within the accessory storage assembly that is attached to the collection drum. In order to further improve the storage system, a drum-attached wand stop is included in an orientation opposite the accessory storage assembly in order to secure the wand's positions in the event of transportation, lifting, and product storage, thereby preventing the wands from being lost or misplaced.

Figure 2:
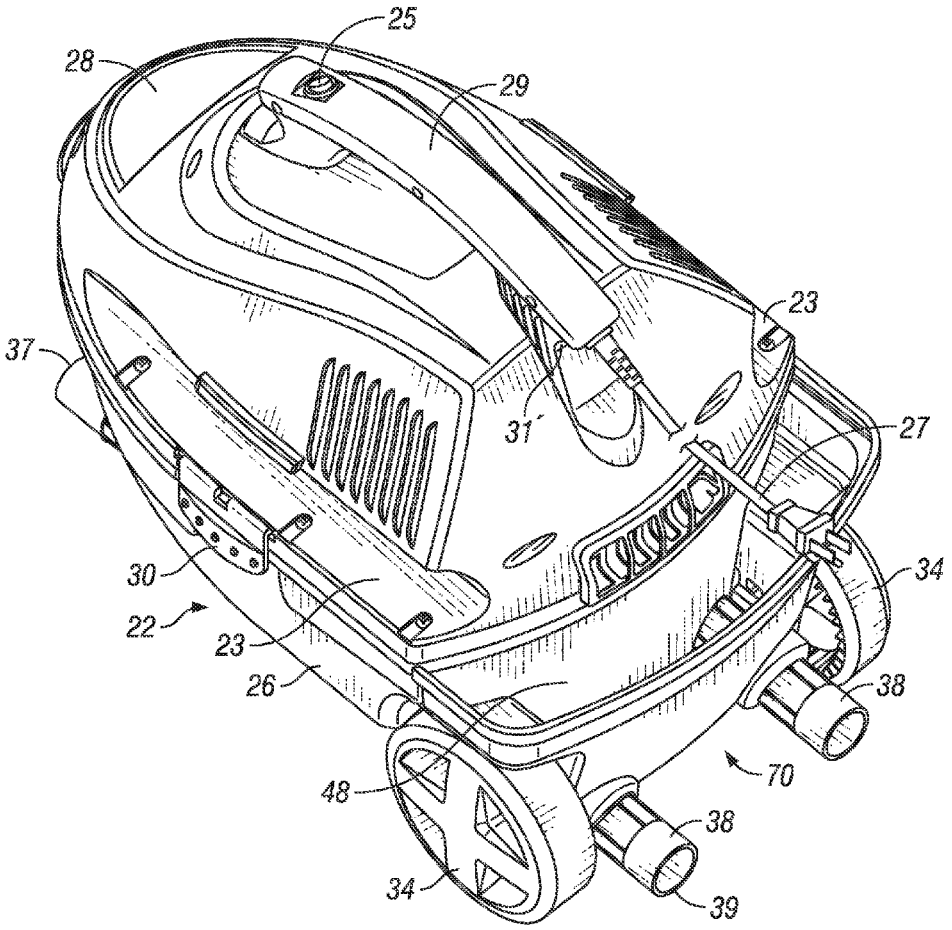
FIG. 2 illustrates a rear perspective view of the vacuum appliance of FIG. 1.
Figure 3:
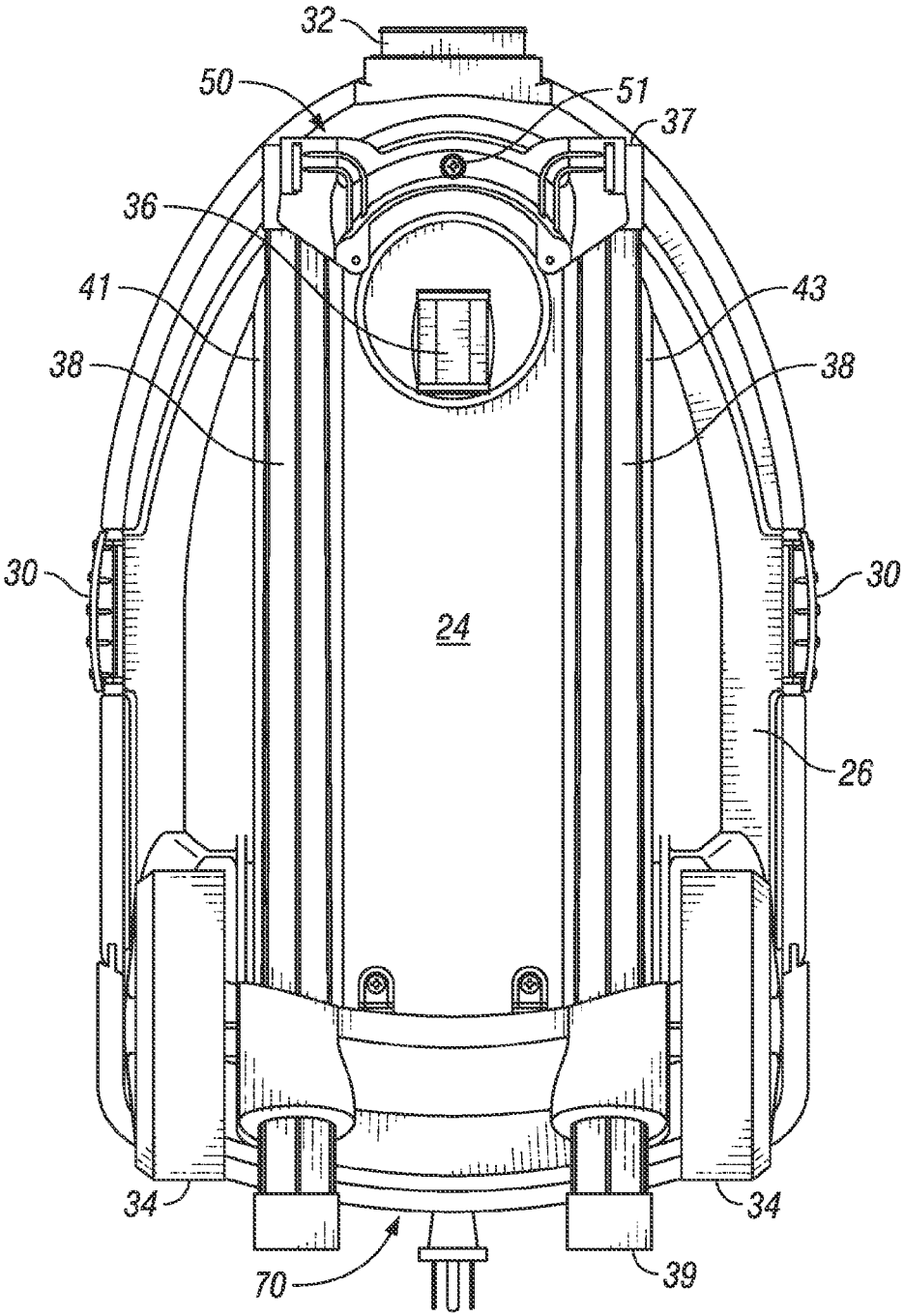
FIG. 3 illustrates a bottom view of the vacuum appliance of FIG. 1.

Referring now to the drawings, FIG. 1 illustrates a front perspective view of a vacuum appliance in accordance with aspects of the present disclosure. FIG. 2 illustrates a rear perspective view of the vacuum appliance of FIG. 1. FIG. 3 illustrates a bottom view of the vacuum appliance of FIG. 1. These figures will now be discussed in conjunction with each other. With specific reference to FIG. 1, a vacuum cleaner constructed in accordance with the teachings of the disclosure is generally referred to by reference numeral 20. While the disclosure and the drawings depict a wet-dry vacuum cleaner of the type adapted to pick up both dry and/or liquid debris, it is to be understood that the teachings of the disclosure can be used in conjunction with other types of vacuum cleaners as well as other types of appliances and tools wherein it is desirable to mount one accessory onto another in a stable and secure fashion. Vacuum 20 as shown in the figures accompanying this disclosure is of a relatively small capacity, having a collection drum volume of approximately 2.5 gallons (although it is understood that a vacuum in accordance with the present disclosure may be larger or smaller than 2.5 gallons in drum capacity). Additionally, while the vacuum cleaner 20 illustrated herein has a generally oblong, non-cylindrical shape, it will be appreciated that the assemblies for extension wand storage described herein may be used in conjunction with vacuum cleaners and wet/dry vacuum appliances having a cylindrical collection drum with a generally circular cross-section, as appropriate.

With continued reference to FIGS. 1-3, the vacuum cleaner 20 is shown to comprise a collection drum 22 having a bottom 24 from which sides 26 extend up, defining an open top (not shown). Drum 22 may be made of blow-molded or extruded plastic, such as polyethylene, polypropylene, or the like. A lid, or power head 28 is removably secured over the top of the collection drum 22 via latches 30 to the side wall 26, so as to close off the open top when desired. Power head 28 houses a motor and impeller assembly for generating the necessary pressure differential within the tank 22 to create the vacuum (the vacuum pressure), and is connected to a filter cage and float assembly (not shown) as appropriate for wet debris pickup, such filter cage being fastened to the power head 28 and extending downwardly into the interior 21 of the drum, or upwardly into the power head, as appropriate. An air inlet 32 is formed in the front portion of the collection drum 22, and is shaped so as to allow the attachment of a flexible vacuum hose 18 via a locking, friction-fit, or other suitable securement means, such as the attachment used with the TUG-A-LONG® locking hose assembly (available from Emerson Professional Tools, St. Louis, Mo.). Optionally, and depending upon the configuration and size of the vacuum appliance 20, the air inlet 32 may be formed in the front portion of the power head 28. As shown in the Figures, power head 28 also includes a handle 29 having power actuating switch 25, and a power cord 27 for powering the vacuum appliance via a typical electrical outlet. The power actuating switch 25 is preferably located towards the front of the handle 29, so that the switch 25 may be conveniently reached with a users thumb or finger while holding the vacuum 20 by the handle 29. The tank 22 may further include a plurality of wheels 34 and casters 36, in any appropriate combination (e.g., two rear wheels and one front caster is illustrated in the present figures), to facilitate movement of the vacuum cleaner 20.

FIGS. 1-3 also illustrate optional notched spaces 31 and 31' formed in handle 29, so that power cord 27 can be wrapped around handle 29 during transport. The figures also illustrate grooves 23 formed in the sides of power head 28, generally in the region of the interface of the collection drum 22 and the power head 28 and parallel to the longitudinal axis of the vacuum 20 (e.g., parallel to the orientation of the handle 29), so that the vacuum hose 18 can be wrapped around vacuum 20 during storage and transport.

FIGS. 1-3 further illustrate the wand accessory storage assembly 40 in accordance with the present disclosure, for use in conveniently storing vacuum hose extension wands 38 when they are not in use. Extension wands 38 are illustrated to be generally cylindrical in shape so as to be generally tubular, and having a front end 37 and a rear end 39 spaced apart longitudinally along a central longitudinal axis of the wand. While the wands 38 are shown to be cylindrical, it will be appreciated that the wands, and the associated receptacles described herein, may be of any shape that is appropriate. The wand accessory storage assembly 40 is secured to the bottom face 24 of the collection drum 22, and includes a front wand securing assembly 50, and a rear wand securing assembly 70, the latter of which includes a rear vacuum accessory caddy, or receptacle having an open side toward the rear peripheral wall of drum 22, and the remaining peripheral walls 72 of the receptacle 70 completing the enclosure of the sides of the receptacle when the receptacle and rear wand securing assembly 70 are installed on the vacuum 20. A plurality of vacuum tools and accessories, such as nozzles, squeegees, and brushes, can be stored in the rear receptacle 70 when they are not in use.

Figure 4:
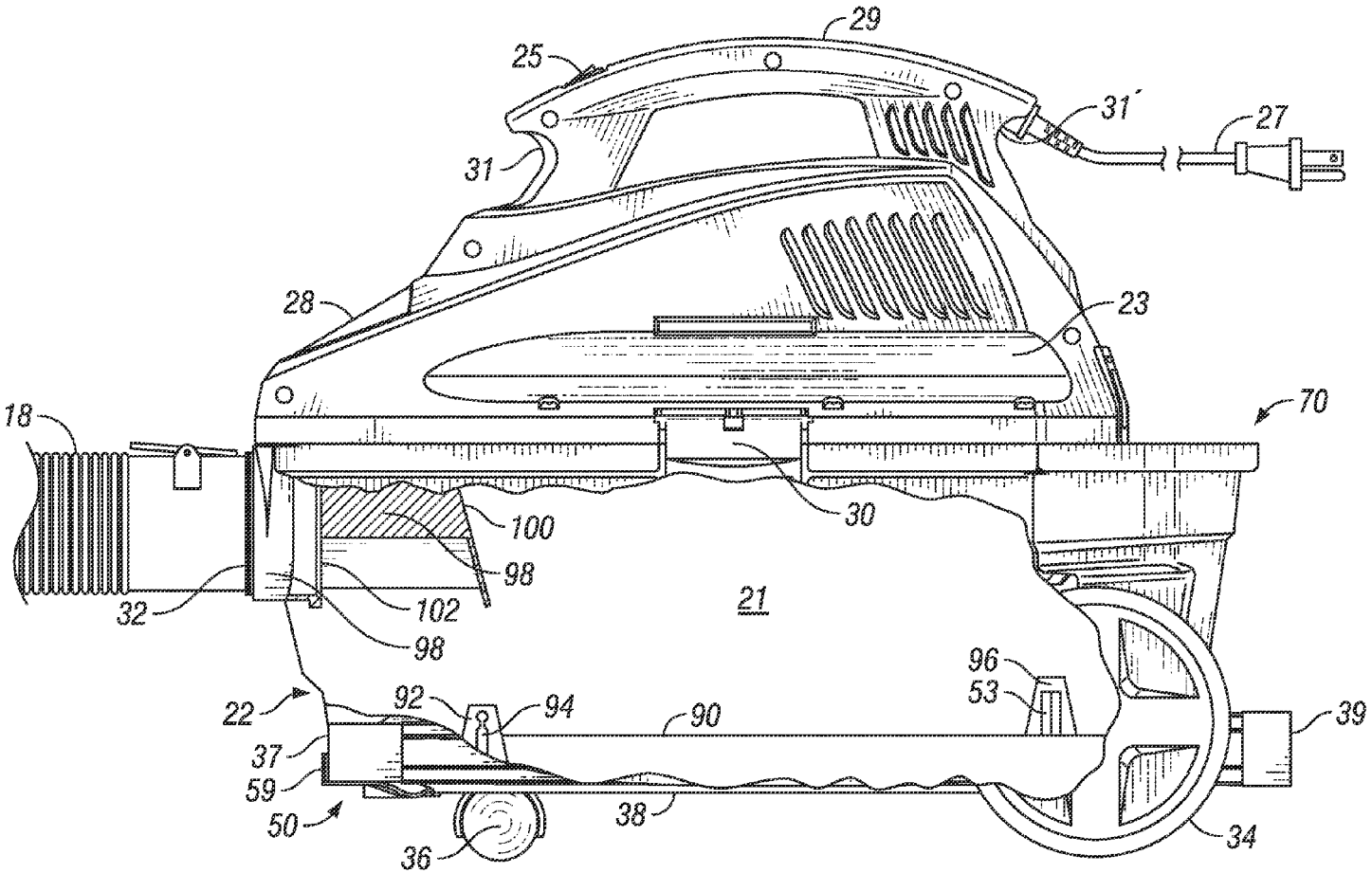
FIG. 4 illustrates a side view of the vacuum appliance of FIG. 1, having a partial cut-away of the drum in cross-section to show further details.
Figure 5:
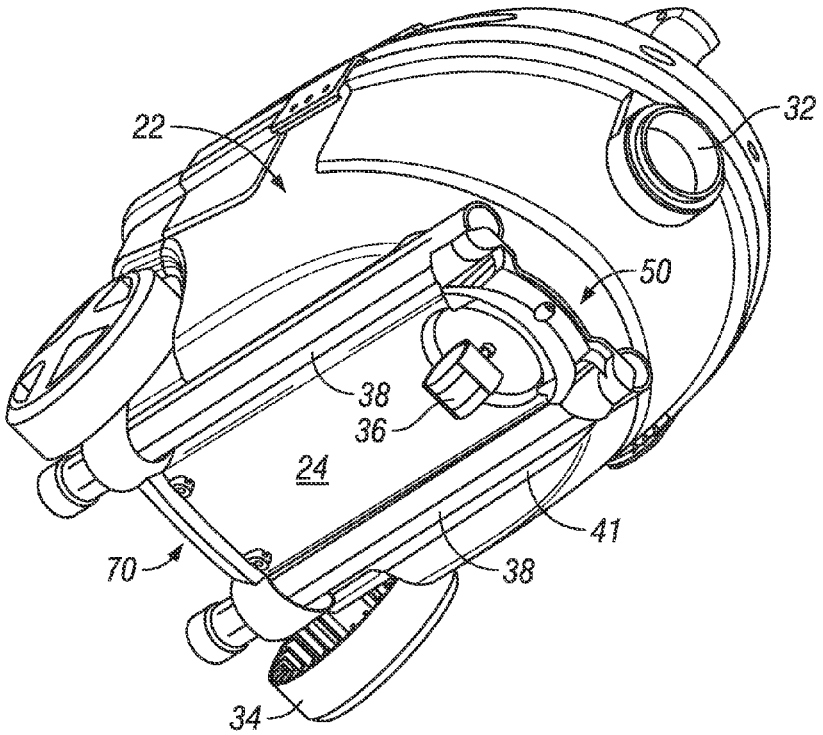
FIG. 5 illustrates a further bottom view of the vacuum appliance of FIG. 1, from a separate perspective.

Turning now to FIGS. 4-10, details of the wand storage assembly 40 are provided. As described above, the wand storage assembly 40 comprises two sections, a front wand securing assembly 50, and a rear wand securing assembly 70, the latter of which is tied to a tool storage receptacle 48. As can be seen most clearly in FIG. 4 and FIG. 10, the rear vacuum extension wand securement assembly 70 is spaced longitudinally apart, and opposite from, the front wand securement assembly 50. Both the front and rear wand securing assemblies are attached directly, via screws or other securement means, to the bottom face 24 of the collection drum 22. As seen in the detail of FIG. 4 and FIG. 5, two integral, shaped (in this case, arched) channels 41, 43 are formed within the bottom face of drum 22, to allow for a more direct pass-through for the wands 38 when they are inserted from the rear assembly 70 towards front securing assembly 50.

FIG. 4 illustrates a side view of an exemplary vacuum appliance 20, showing a partial cut-away cross section of the drum 22 so as to illustrate added details of the drum and extension wand securement assembly 40. As can be seen therein, the bottom face 24 of the collection drum 22 can include at least one front indented receptacle 92 and spaced apart rear indented receptacles 96 formed or molded into the bottom of the drum itself and extending upwardly into the interior 21 of the drum. Caster mounting shank 94 associated with a front caster 36 is installed in the opening 92 in bottom of the drum 22, thus enabling the attachment of the caster(s) 36 beneath the collection drum. Securement prongs 53 on rear securement assembly 70 may be inserted within the indented receptacles 96 in the bottom face of the drum 22 so as to engage the rear securement assembly 70 with the drum 22, at least in part. Other indented receptacles and securement prongs on these components may be included within the overall drum design, as appropriate, depending upon the size and attachment requirements of the assembly 70 (e.g., additional receptacles may be formed high up the interior 21 of the drum). Other suitable receptacles and engaging means may be substituted for either holding the casters or securing at least a part of the rear securement assembly 70 in the receptacles beneath the drum 22. As also shown in FIG. 4, the bottom of the drum 22 may further include one or more raised regions 90 extending upwardly into the interior of the drum, shaped to coincide with the shaped channels 41, 43 formed into the bottom of the collection drum.

As further shown in the cut-away section of FIG. 4, the vacuum air inlet 32 includes an aperture extending from the exterior to the interior 21 of the collection drum. A cylinder 98 circumscribes the aperture and extends substantially orthogonally to the front wall of the drum 22. The cylinder 98 extends from the exterior of the drum inward in a substantially orthogonal direction before curving radially inwardly and terminating in a deflector 100. An outlet 102 is provided in a side wall of the cylinder 98 as shown in FIG. 4. As a result of the curvilinear or angled shape of the deflector 100, a fluid stream directed in through the aperture via inlet 32 is deflected in the direction of the deflector 100 toward the outlet 102. Therefore, depending upon the position of the deflector 100, the direction of the exiting fluid stream will be affected.

More specifically, as depicted in FIG. 4, the deflector 100 may be directed downwardly such that the outlet 102 opens downwardly into the collection drum 22. Such a position for the deflector 100 would be appropriate when the vacuum cleaner 20 is used in conjunction with a vacuum bag, and/or when dry materials are being vacuumed. Conversely, while not specifically shown in the figures, the deflector 100 may be positioned upwardly such that the outlet 102 opens upwardly within the interior 21 of drum 22 and proximate a downwardly depending shroud (not shown) of the bottom face of the power head 28. Such would be the position for vacuuming wet materials. In so doing, the liquid entering through the vacuum air inlet 32 would be directed by the deflector 100 toward the shroud and against which the liquid would be imparted to thereby slow the liquid before dropping into the drum 22. As a result, splashing of the liquid is lessened and the likelihood of splashing liquid being drawn into the motor/impeller unit and expelled through the blow outlet, or any other outlet provided within the vacuum cleaner 20, is abated.

Figure 6:
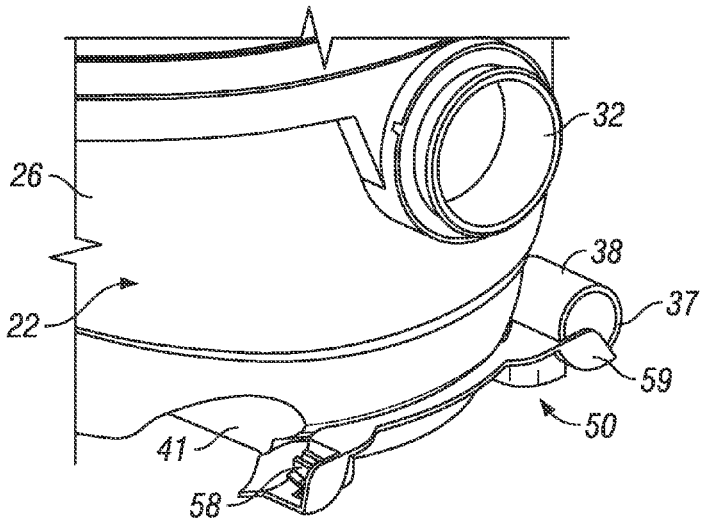
FIG. 6 illustrates a partial cut-away view of the front securing assembly attached to a vacuum appliance.
Figure 7:
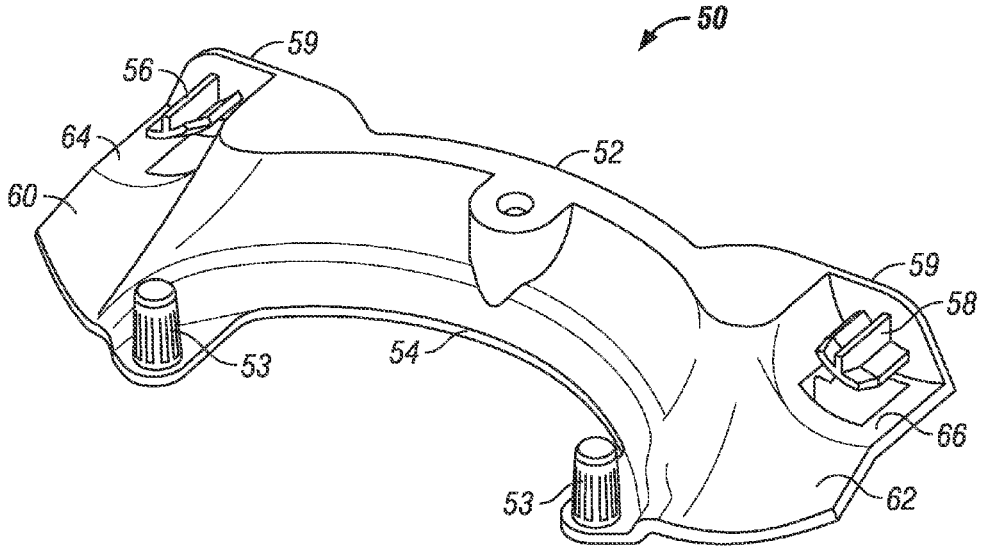
FIG. 7 illustrates a detailed view of an exemplary front securing assembly in accordance with the present disclosure, removed from the appliance.

As illustrated in FIGS. 5-7, the front wand securement stop assembly 50 is located on the bottom 24 or lower wall region of the collection drum 22 generally opposite the rear securement assembly 70, preferably below the section of the drum having the inlet 32. The stop assembly 50 preferably includes a wand positioning and retaining stop, such as pinch fingers 56, 58 as shown in FIG. 7, so as to securely retain the extension wand 38 in place once it has been inserted into the securement assembly 40. Details of the front wand securement stop assembly 50 are illustrated in FIG. 5, FIG. 6. and FIG. 7. Stop assembly 50 includes a front end 52, a spaced apart back edge 54, and side regions substantially perpendicular thereto comprising shaped slots 60, 62 forming the bottom of the side regions, retaining ledges 64, 66 in front of and slightly above the shaped slots, and wand stops 59 at the front edge of the ledges, the wand stops 59 being substantially perpendicular to ledges 64, 66, and substantially parallel with the front end 52 of the assembly 50, as well as the wall 26 of the collection drum 22. Extending inward (toward the back edge 54) from the wand stops 59 are pinch fingers 56, 58 which serve to securely retain the front ends 37 of the wands 38 in place. Pinch fingers 56, 58 extend generally parallel with the bottom 21 of the collection drum, and generally parallel to the slots 60, 62 and retaining ledges 64, 66. Securement prongs 53 on the back edge 54 of the front wand securement stop assembly 50 extend upward and during installation of the assembly 50 extend upward into receptacles formed into the base of the collection drum.

Figure 8:
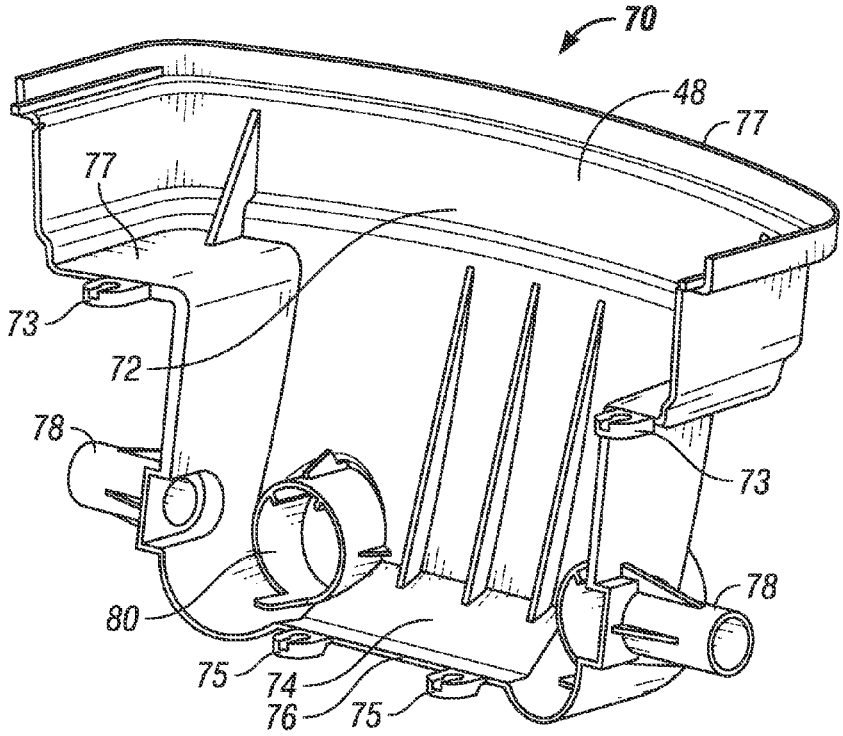
FIG. 8 illustrates a perspective view into the interior of the rear securing assembly removed from the vacuum appliance.
Figure 9:
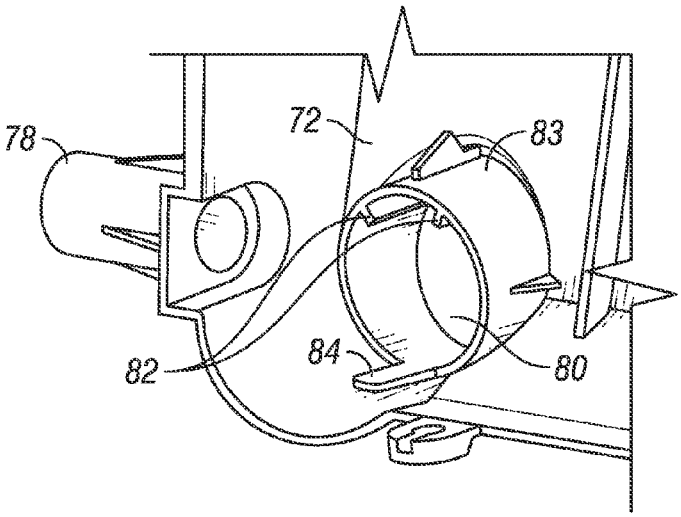
FIG. 9 illustrates an enlarged, partial sectional view of the rear securing assembly in accordance with the present disclosure, showing details of the wand centering ribs and wand guides.
Figure 10:
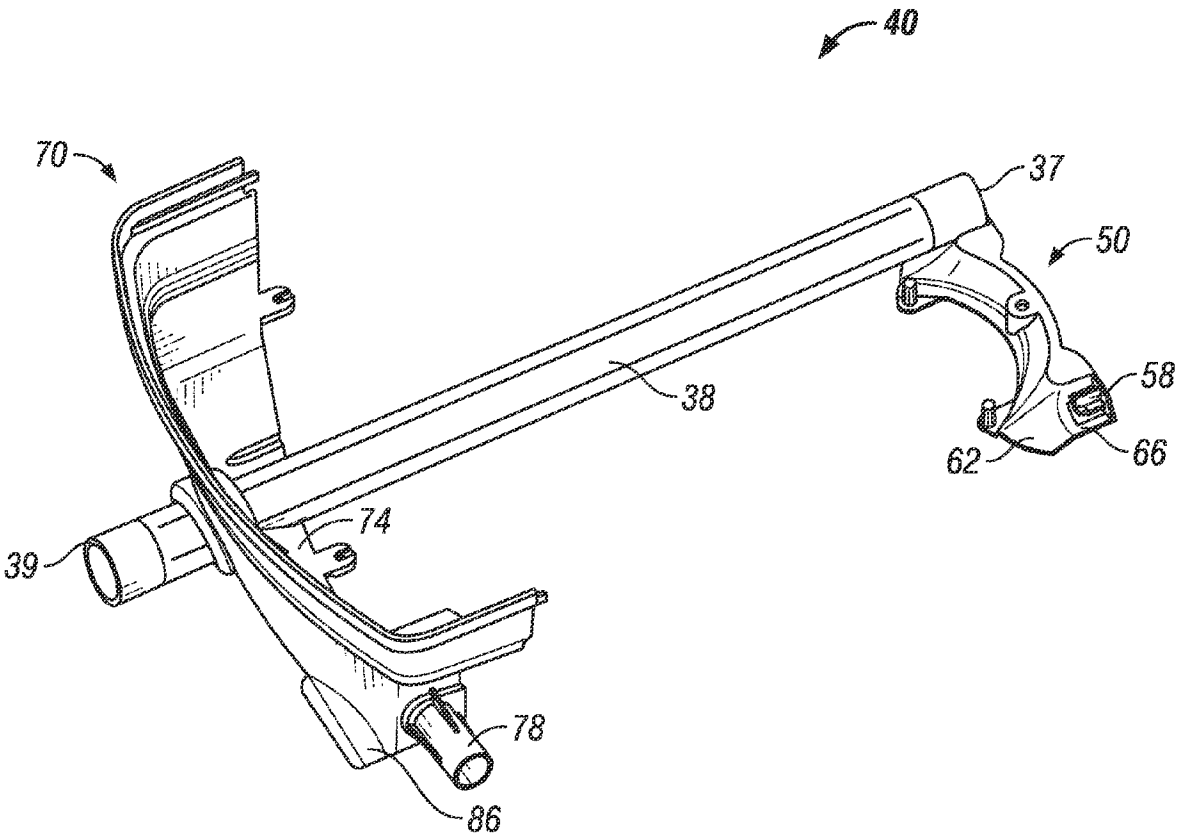
FIG. 10 illustrates an exemplary want storage assembly in accordance with the present disclosure, with the vacuum debris collection drum not shown for purposes of clarity.

Turning now to the rear wand securement assembly 70, which is spaced apart and opposite from the front securement assembly 50, the rear assembly 70 includes a tool caddy receptacle 48 (alternatively referred to as an accessory storage bin) that is formed with and is a part of the rear wand securement assembly 70, and which aligns with an outward wall of the collection drum 22, wherein the caddy region 48 further includes a bottom wall, or floor, 74 from which a continuous side wall 72 upwardly extends. Referring to FIGS. 8-10, the rear securement assembly 70 includes a caddy region 48 having an open side toward the peripheral wall of the drum 22, and wheel axle sleeves 78 extending outwardly from the assembly 70. The remaining peripheral walls 72 of the caddy complete the enclosure of the sides of the caddy region of the rear assembly 70 when the caddy is installed around the drum. The caddy may have an additional wall enclosing the tank facing side. However, such a wall is not necessary. Like the drum 22, the rear securement assembly 70 and associated caddy region 48 may be of a one piece plastic molding. The floor 74 of the caddy region typically has a concavely curved internal periphery 76 which mates with the periphery of the drum 22 so that the caddy region 48 of the rear securement assembly 70 can be pressed against the drum 22 without leaving a space between them.

Molded under the floor 74 of the assembly 70, as well as extending from hubs 77 in the body of the assembly 70, there are caddy mounting fixtures 73 and 75 which are spaced apart from each other and correspond to the locations of the indented receiving receptacles 96 beneath the drum 22. On each fixture 73, 75 an opening extends substantially therethrough, which is placed and shaped to receive the respective securement means (such as a threaded screw) inside the respective receptacle 96 beneath the drum 22. By inserting a securement means into the opening 96, the fixture 73, 75 is installed in the receptacle 96 beneath the tank which secures the caddy to and beneath the drum.

As illustrated in FIG. 8 and FIG. 9, the rear wand securement assembly 70 further includes openings 80 extending through the walls 72, located near the intersection of the walls 72 and the floor 74, and spaced apart from each other. A section of the floor 74 of assembly 70 extends inward toward the drum 22, and is shaped to support the wands 38, the shape being similar to the exterior shape of the wands themselves. A cylinder, or retaining ring 86 extends from the exterior of the rear securement assembly 70 inward in a substantially orthogonal manner, relative to the back wall 72' of the assembly 70 defining the caddy region 48. A plurality of wand centering ribs 82 are formed in the inside wall, preferably the upper inside wall, of retaining ring/cylinder 86 proximate the back wall of the accessory storage bin 48. These centering ribs 82 can align with grooves formed on the exterior of the wands 38 to prevent wand rotation and/or to act as further retaining means in securing the wands in position beneath the drum. Additionally, one or more springing means, such as spring fingers 84, can be located on the bottom inside wall of cylinder 86, substantially opposite wand centering ribs 82, so as to elevate the extension wands 38 into the arched channel 41, 43 formed in the bottom face of the vacuum drum 22 and guide them towards the front securement assembly 50, or both.

In typical use, when a user has completed a vacuuming operation and wants to store the hose extension wands 38, the user inserts the front end 37 through an opening 80 in the rear assembly 70. As the wand 38 is inserted, spring finger 84 elevates and directs the wand into a shaped channel 41 in the bottom face of the collection drum 22. Further insertion by the user directs the front end 37 of the wand to abut with stop 59, and simultaneous retainment in position by a pinch finger 56 entering the interior of the wand 38 as it abuts stop 59. In this manner, extension wand 38 is stored below the collection drum 22, extending only minimally, if at all, at the back end 39 of the wand from the rear face of the rear securement assembly 70.

Other and further embodiments utilizing one or more aspects of the inventions described above can be devised without departing from the spirit of Applicant's invention. For example, the shape of the debris collection drum may be round, square, rectangular, or any other appropriate shape, or the latching mechanisms for attaching the motor and lid to the collection drum may be offset, or on the same side if desired. Further, the various methods and embodiments of the use and assembly of the vacuum cleaners described herein can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A wet/dry vacuum appliance comprising:

a collection drum having a bottom and an outside wall, the bottom of the drum having at least one channel with a shaped surface being formed into the bottom face thereof;

a lid mounted to the collection drum;

a motor impeller unit mounted in the lid; and a vacuum extension wand storage assembly attached to the bottom face of the collection drum, the wand storage assembly comprising a front securement assembly and a rear securement assembly spaced longitudinally apart and opposite from the front securement assembly.

2. The wet/dry vacuum appliance of claim 1, further comprising a tool caddy receptacle formed within the rear wand securement assembly and which aligns with an outward wall of the collection drum, wherein the caddy further includes a bottom wall from which a continuous side wall upwardly extends.

3. A vacuum extension wand storage assembly for use with a vacuum appliance having a collection drum with a bottom and upwardly extending sides, the assembly comprising:

a front vacuum extension wand securement assembly attached to the bottom of the collection drum;

a rear vacuum extension wand securement assembly attached to the bottom of the collection drum, and spaced longitudinally apart from the front securement assembly;

at least one channeled, arched surface formed in the bottom face of the collection drum and sized to receive a vacuum extension wand; and a tool caddy receptacle formed with the rear wand securement assembly and which aligns with an outward wall of the collection drum, wherein the caddy further includes a bottom wall from which a continuous side wall upwardly extends.

4. The vacuum wand extension assembly of claim 3, wherein the front wand securement assembly includes a wand positioning and retaining stop.

5. The vacuum wand extension assembly of claim 3, wherein the rear wand securement assembly includes wand centering ribs formed in a retaining ring, one or more springing means to elevate the extension wands into the arched channel formed in the bottom face of the vacuum drum and guide them towards the front securement assembly, or both.

6. A method of attaching vacuum extension wands into a vacuum wand securement assembly attached to a wet-dry vacuum cleaner, the method comprising:

mounting a vacuum wand securement assembly onto the bottom face of a collection drum of a wet-dry vacuum cleaner, wherein the bottom face of the collection drum includes shaped channels formed in the bottom face of the drum, and wherein the wand securement assembly includes a front wand securement assembly having at least one wand-positioning and retaining tabbed stop means, and, a longitudinally spaced apart rear wand securement assembly having at least one aperture formed therein, the aperture including plurality of wand-centering ribs circumscribing the inner face, such that the front retaining means, shaped channels, and circular apertures are substantially in a planar alignment;

inserting a vacuum extension wand into the securement assembly by inserting the front of the extension wand through the circular aperture in the rear assembly, along a shaped channel, and towards the front securement assembly; and positively connecting the front of the extension wand with the front securement assembly by engaging the wand with the tabbed stop means.

* * * * *